United States Patent [19]

Roeder

[11] Patent Number: 4,568,323

[45] Date of Patent: Feb. 4, 1986

[54] STRIP STEEL STAMPING OR PUNCHING TOOL FOR CARTON BLANKS OR THE LIKE

[75] Inventor: Walter Roeder, Frankfurt, Fed. Rep. of Germany

[73] Assignees: R & S Stanzformen GmbH, Frankfurt; Karl Stursberg KG, Wuppertal, both of Fed. Rep. of Germany

[21] Appl. No.: 607,939

[22] Filed: May 7, 1984

[30] Foreign Application Priority Data

May 16, 1983 [DE] Fed. Rep. of Germany ..... 3317777

[51] Int. Cl.[4] ..... B31B 49/00

[52] U.S. Cl. ..... 493/473; 493/61; 493/363; 493/372

[58] Field of Search ..... 493/61, 160, 162, 228, 493/363, 366, 372, 473; 76/107 C

[56] References Cited

U.S. PATENT DOCUMENTS

| | | | |
|---|---|---|---|
| 2,552,353 | 5/1951 | Troth | 493/363 |
| 2,586,744 | 2/1952 | Troth | 493/61 |
| 2,589,022 | 3/1952 | Page, Jr. et al. | 493/62 |
| 3,590,695 | 7/1981 | Gerard | 493/363 |
| 4,399,935 | 8/1983 | Nelden | 493/61 |

FOREIGN PATENT DOCUMENTS 17179 3/1980 European Pat. Off. .

*Primary Examiner*—W. D. Bray

*Attorney, Agent, or Firm*—W. G. Fasse; D. H. Kane, Jr.

[57] ABSTRACT

Strip steel stamping knives (1) and, if desired, the strip steel folding rules (2) of a strip steel stamping tool are provided in slots (3, 4) in a carrier plate (5). The strip steel stamping knives and, if desired, the strip steel folding rules protrude downwardly from the carrier plate to cooperate with a counter stamping plate (7). The backs of the stamping knives (1) and, if desired, of the folding rules (2), face a hardened pressure plate (9). In order to achieve an automatic height or elevational adjustment of the stamping knives (1), and if desired, of the folding rules (2), the backs of the stamping knives and, if desired, of the folding rules, are also constructed as hardened cutting edges (11, 12). An intermediate plate (10) is placed between the carrier plate (5) and the pressure plate (9). The hardness of the intermediate plate is less than that of the cutting edges (11, 12) of the stamping knives (1) and, if desired, of the folding rules (2), so that these cutting edges may penetrate into the intermediate plate during an elevational equalization.

7 Claims, 5 Drawing Figures

FIG. 1
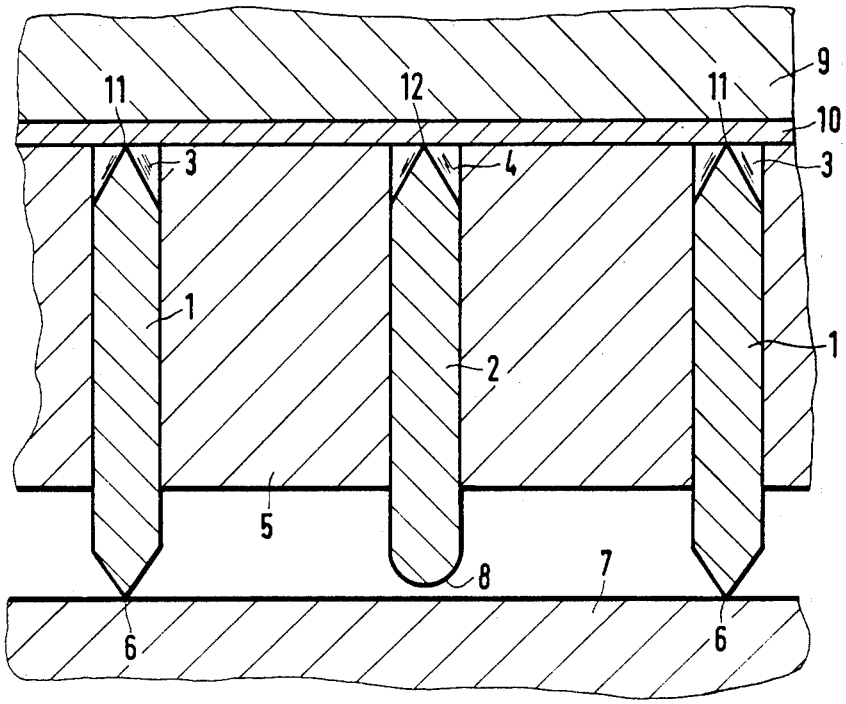
FIG. 2
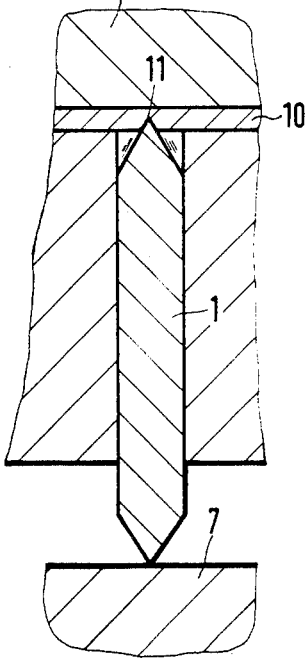
FIG. 3
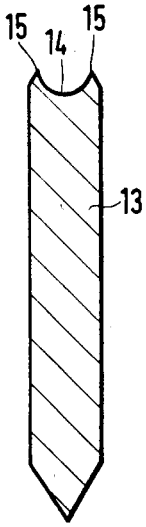
FIG. 4
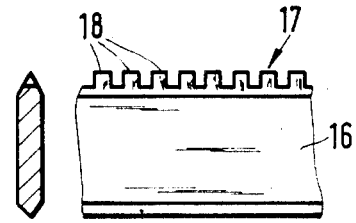
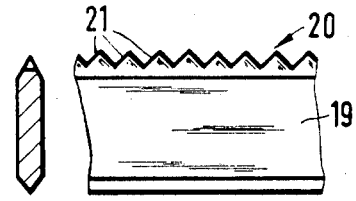
FIG. 5

STRIP STEEL STAMPING OR PUNCHING TOOL FOR CARTON BLANKS OR THE LIKE

FIELD OF THE INVENTION

The invention relates to a strip steel stamping or punching tool for carton blanks or the like, especially folding box blanks, having at least one strip steel stamping knife inserted into a slot in a carrier plate. A hardened cutting edge of the stamping knife protrudes from the slot. The spine of the stamping knife faces an intermediate plate and a hardened pressure plate.

DESCRIPTION OF THE PRIOR ART

Such strip steel tools (EP-OS) No. 0,017,179, corresponding to U.S. Pat. No. 4,326,434, are secured to the upper table of a punching press and work against a counter stamping plate arranged in plane parallel fashion on the lower table of the punching press. In practice it is important that the cutting edges, the so-called strip steel stamping lines protruding from the carrier plate, have the same elevational location, so that the material to be stamped, which lies on the surface of the counter stamping plate, is evenly cut along all of the cutting edges. Otherwise, it is not possible to cleanly break the blanks out of the planar material. Obtaining an even elevational adjustment of the cutting edges when setting up a stamping press is a problem that has been known for a long time to those skilled in this art and until now has not been satisfactorily solved. In order to even out the unavoidable height or elevational tolerances, which may amount to several tenths of a millimeter, it is customary to use shim strips to back the spines of the strip steel stamping knives which are not cutting through. These set-up procedures are, however, very time consuming, and in addition must be repeated if the strip steel tool is to be reused repeatedly at time intervals. This occurs often in practice for repeat orders.

OBJECT OF THE INVENTION

It is the object of the present invention, to construct a strip steel stamping or punching tool, by means of which trouble-free cuts may be carried out without additional adjustment procedures, even if the strip steel stamping or punching tool is to be used repeatedly.

SUMMARY OF THE INVENTION

This object is achieved in an apparatus of the initially described type, in that the back of the strip steel stamping knife is also constructed as a hardened cutting edge.

When the strip steel stamping tool according to the invention is used for stamping, it does not have initially any height or elevational adjustment. Hence, the cutting edges or cutting edge areas which protrude the furthest from the carrier plate will be first to contact the material to be stamped or the counter stamping plate, whereby increased pressing forces arise at these cutting edges or cutting edge areas. These forces lead to a slight height or elevational repositioning of the respective strip steel stamping knives in their slots in the carrier plate, whereby. the rear cutting edges of the strip steel stamping knives are pressed into the softer intermediate plate until all of the strip steel stamping lines are uniformly loaded, in the further course of the stamping movement. This situation corresponding to a uniform height or elevational position, may already be achieved during the first test cuts, without requiring any special height or elevational adjustment operations. The desired uniform elevational position is achieved automatically through the interaction between the rear cutting edge and the softer intermediate plate.

The stamping tool according to the invention may be used repeatedly, whereby it is merely necessary that new areas of the intermediate plate lie opposite the rear cutting edges of the strip steel stamping knives. This may be achieved by a slight sliding relocation of the intermediate plate in the x- and y-directions. Furthermore, the intermediate plate may be turned over, whereby the intermediate plate also may be used repeatedly. Even if a new intermediate plate is used for each new set-up of the respective strip steel stamping tool, the resulting expense is small, because the cost of the intermediate plate is only a small fraction of the total cost of the strip steel stamping tool.

Since the described height or elevational tolerances amount only to a few tenths of a millimeter, even when they are unfavorably added, it is sufficient that the intermediate plate is thin and single-layered. Its thickness should be slightly greater than the expected maximum tolerance sum, in order to avoid, as much as possible, separating or severing cuts through the intermediate plate at the indent locations of the rear cutting edges. Correspondingly, a few tenths of a millimeter is sufficient for the thickness of the intermediate plate. Good results were obtained with a 0.3 mm thick intermediate plate, for example.

In a further embodiment of the invention, the intermediate plate is made of a material which is ductile or tough relative to a notched impact load. Such material should have a Rockwell hardness up to about 50% of the Rockwell hardness of the hardened cutting edges of the strip steel stamping knives. The Rockwell hardness of the hardened cutting edges of the strip steel stamping knives is customarily about 50. Thus, the lower Rockwell hardness of the intermediate plate lies between about 40 and 25.

The Rockwell hardness of the material of the intermediate plate may even be below 25, with a proper construction of the back cutting edge of the strip steel knife. For instance, this is true for a wedge-shaped cutting edge because the penetration resistance increases corresponding to the increasing surface area of the penetrating cutting edge zones.

Advantageously, the intermediate plate is made of a metal which is soft in comparison to the hardness of the cutting edge. However, synthetics materials may also be used for makihg the intermediate plate; for instance polytetrafluoroethylene. According to the invention, the back cutting edge of the strip steel stamping knife may have a varied construction, for example, it may be identical to the front cutting edge which makes the stamping cut, whereby the production of the strip steel stamping knife is considerably simplified. However, one may also advantageously construct the back of the strip stamping knife as a hardened double cutting edge by means of hollow grinding. The back of the strip steel stamping knife may also be formed as a hardened sawtooth cutting edge, for interacting with certain materials of the intermediate plate. Depending on the shape of the sawteeth, a cutting edge may comprise individual, short, spaced apart cutting edges (for example square sawteeth). In the extreme case, the cutting edge may comprise a row of points or peaks arranged at uniform spacings (triangular sawteeth). Since the surface pressure on such a sawtooth cutting edge is greater under a comparable load, the intermediate layer material may have a greater hardness than with an uninterrupted, full-length back cutting edge.

Where, according to the invention, a strip steel stamping tool is equipped additionally, with at least one strip steel folding rule mounted in a slot of the carrier plate and protruding therefrom less than the strip steel stamping knife, the arrangement may be such that the strip steel folding rule also has a hardened back cutting edge. In such an embodiment the strip steel folding rules are automatically set to a uniform height or elevation position after the strip steel stamping knives have assumed such a position. This automatic adjustment occurs in that the back cutting edges of the strip steel folding rules are pressed more or less deeply into the intermediate plate according to the height or elevation tolerances at hand during a stamping and folding operation.

BRIEF FIGURE DESCRIPTION

Further details of the invention will be described more closely in the following with reference to the drawings, which show example embodiments, wherein:

FIG. 1 shows a partial section through a strip steel stamping tool, before the automatic equalization of the height or elevation difference;

FIG. 2 is a partial section through a strip steel stamping tool, after the automatic height or elevation difference equalization;

FIG. 3 is a section through a strip steel stamping knife with a knife back construction different from the examples according to FIGS. 1 and 2;

FIG. 4 is a section and a partial side view of a different example embodiment of the strip steel stamping knife; and FIG. 5 also shows a section and a partial side view of a further example embodiment of a strip steel stamping knife.

DETAILED DESCRIPTION OF PREFERRED EXAMPLE EMODIMENTS AND OF THE BEST MODE OF THE INVENTION

In FIGS. 1 to 3, the strip steel stamping tool is shown on a considerably larger scale as compared to reality. However, in FIGS. 4 and 5 only the thickness of the strip steel stamping knives is shown exaggeratedly large in order to be clearer.

The strip steel stamping tool seen in FIG. 1 shows two strip steel stamping knives 1 and a strip steel folding rule 2 located between the knives 1. Each knife and rule is set into a slot 3 or 4 of the carrier plate 5 which customarily is made of plywood. Each strip steel stamping knife 1 protruding downwardly out of the carrier plate 5 comprises a wedge-shaped ground and hardened cutting edge 6 which cooperates with a counter stamping plate 7 for stamping a flat material, for example cardboard, which rests on the counter stamping plate 7.

In order to produce a groove or fold line, the strip steel folding rule 2 is rounded on its outer end 8, and protrudes downwardly from the carrier plate to a lesser extent than the cutting edges 6.

A hardened pressure plate 9 is arranged for bracing the strip steel stamping tool. A thin single-layered intermediate plate 10 is located between the pressure plate 9 and the carrier plate 5.

The strip steel stamping knives 1, and if provided, the strip steel folding rules 2, also comprise wedge-shaped ground and hardened cutting edges 11 or 12 along their backs or spines. These cutting edges 11 or 12 lie against the facing surface of the intermediate plate 10 before the first stamping or punching operation. The intermediate plate 10 is made of a material which has a lower hardness than the cutting edges 11, 12 facing the intermediate plate 10.

Due to this hardness difference, the cutting edges 11, 12 can penetrate into the intermediate plate 10 to equalize or even out height or elevation tolerances, as is shown in FIG. 2, for example, by the cutting edge 11 of a strip steel stamping knife 1.

The strip steel stamping knife 13 shown in FIG. 3 comprises on its back a hollow-ground groove 14, whereby a double cutting edge having two cutting edges 15, located at the same height or elevation, is formed.

In the example embodiment according to FIG. 4, the back cutting edge of a strip steel stamping knife 16 is constructed as a sawtooth cutting edge 17 comprising separate sawteeth 18. In the example embodiment according to FIG. 5, the strip steel stamping knife 19 is similarly equipped with a back sawtooth cutting edge 20 with sawteeth 21 having a triangular shape. In both example embodiments correspond to FIGS. 4 and 5, the back cutting edges 17 or 20 lie against the intermediate plate with a considerably reduced contact surface, whereby surface pressures of considerable magnitude arise during the automatic height or elevation equalization. These surface pressures make the penetration of the teeth 18 of 21 into the material of the intermediate plate 10 easier. Hereby the hardness of the intermediate plate 10 may be greater than in the example embodiment according to FIGS. 1 and 2, whereby however, the hardness of the intermediate plate 10 always remains lower than the hardness of the cutting edges 17 or 20.

Although the invention has been described with reference to specific example embodiments, it will be appreciated, that it is intended to cover all modifications and equivalents within the scope of the appended claims.

I claim:

1. A strip steel stamping tool for cutting blanks of carboard or the like, comprising strip steel knife means having a hardened first cutting edge and a knife back also constructed as a hardened second cutting edge (11), a carrier plate, slot means in said carrier plate for holding said strip steel knife means so that said first cutting edge protrudes from said slot means, said stamping tool further comprising a hardened pressure plate (9) and a penetrable intermediate plate (10) sandwiched between said carrier plate and said hardened pressure plate (9) so that the hardened second cutting edge (11) faces said intermediate plate, whereby said hardened second cutting edge may penetrate into said intermediate plate (10) in operation.

2. The strip steel stamping tool of claim 1, wherein said first and second hardened cutting edges have a given Rockwell hardness, and wherein said intermediate plate (10) is made of a material which is tough relative to notch impact loads and has a Rockwell hardness up to about 50% of said Rockwell hardness of said hardened cutting edges (6, 11) of the strip steel stamping knife means.

3. The strip steel stamping tool of claim 1, wherein said intermediate plate (10) is made of a metal which is softer than the hardness of the cutting edge (11).

4. The strip steel stamping tool of claim 1, wherein said intermediate plate is made of polytetrafluoroethylene.

5. The strip steel stamping tool of claim 1, wherein the back of the strip steel stamping knife means (13) is constructed as hardened double cutting edges (15) with a groove (14) between the double cutting edges (15).

6. The strip steel stamping tool of claim 1, wherein the back of the strip steel stamping knife means (16, 19) is constructed as a hardened sawtooth cutting edge (17, 20).

7. The strip stamping tool of claim 1, further comprising at least one additional strip steel folding rule also set into said slot means of said carrier plate and protruding therefrom less than the strip steel stamping knife, said strip steel folding rule (2) having a back also constructed as a hardened cutting edge (12).

* * * * *

UNITED STATES PATENT AND TRADEMARK OFFICE

CERTIFICATE OF CORRECTION

PATENT NO. : 4,568,323

DATED : February 4, 1986

INVENTOR(S) : Walter Roeder

It is certified that error appears in the above—identified patent and that said Letters Patent is hereby corrected as shown below:

Claim 1, (column 4, line 44) replace "carboard" by --cardboard--.

Claim 7, (column 6, line 3) after "strip" insert --steel--.

Signed and Sealed this

*Thirteenth* Day of *May 1986*

[SEAL]

*Attest:*

DONALD J. QUIGG

*Attesting Officer*

*Commissioner of Patents and Trademarks*